US006029654A

United States Patent [19]

Wade

[11] Patent Number: 6,029,654

[45] **Date of Patent: *Feb. 29, 2000** a

[54] VENTED FIREPLACE CONSTRUCTION

[75] Inventor: Melvin Wade, Bridgeport, Ala.

[73] Assignee: Temco Fireplace Products, Inc., Nashville, Tenn.

[ * ] Notice: This patent is subject to a terminal disclaimer.

[21] Appl. No.: 09/181,410

[22] Filed: Oct. 28, 1998

Related U.S. Application Data

[63] Continuation-in-part of application No. 08/787,794, Jan. 23, 1997, Pat. No. 5,901,701.

[51] Int. Cl.[7] ..... F23C 1/18; F24B 1/88

[52] U.S. Cl. ..... 126/512; 126/529; 126/530; 126/77; 126/547

[58] Field of Search ..... 126/512, 531, 126/77, 547, 529, 530

[56] References Cited

U.S. PATENT DOCUMENTS

| | | | |
|---|---|---|---|
| 5,249,567 | 10/1993 | Maitland | 126/519 |
| 5,263,471 | 11/1993 | Shimek et al. | 126/528 |
| 5,701,882 | 12/1997 | Champion | 126/523 |
| 5,941,237 | 8/1999 | Shimek et al. | 126/512 |

*Primary Examiner*—Ira S. Lazarus
*Assistant Examiner*—David Lee
*Attorney, Agent, or Firm*—Alan Ruderman; Miller & Martin, LLP

[57] ABSTRACT

A vented wood or gas-log fireplace is formed from a sheet metal member bent to form side and rear panels. A pair of spaced apart sheet metal plates are connected between the side panels and have rear edges spaced from the rear panel. The rear edges of the plates are bent to form lips extending in a direction toward the opposite plate. Bracket members are secured to the plates adjacent the side panels. A rear refractory member is positioned between the plates in engagement with the lips, and side refractory panels are positioned in abutment with a respective side sheet metal panel and held in place by the bracket members, the side ceramic panels abutting the rear ceramic panel at the sides thereof. A top panel is fastened to the top edges of the side panels above the top plate and a conduit extends through the top plate with the top panel to communicate the combustion chamber with an exhaust pipe or chimney. An air duct is formed between the top panel and the top plate, and a front face assembly having upper and lower grids permits air to flow beneath the lower plate, upwardly between the rear ceramic panel and the rear sheet metal panel, and over the upper plate, below a top panel, the front face assembly having rearwardly extending ledges which provide support for the plates adjacent the front edges thereof.

9 Claims, 3 Drawing Sheets

VENTED FIREPLACE CONSTRUCTION

REFERENCE TO RELATED APPLICATIONS

This application is a Continuation-in-part of U.S. patent application Ser. No. 08/787,794 filed Jan. 23, 1997, now U.S. Pat. No. 5,901,701.

BACKGROUND OF THE INVENTION

This invention relates to fireplaces and more particularly to a fireplace which vents externally and has a construction which permits use of larger log sets and is less expensive to produce than prior art constructions.

Gas burning log sets having artificial logs which are either placed within an unvented fireplace or an unvented fireplace insert are today very popular since the burning gas supplies a very high heat level, e.g., in the order of 40,000 BTU, efficiently. Substantially all of the gas is burned cleanly and the burning efficiency is very high while the carbon monoxide and carbon dioxide generated generally does not exceed acceptable limits. Such a fireplace wherein the combustion products need not be vented outside the building and may be directed into the room to heat the room is disclosed in the aforesaid application. The fireplace in which the burning log set is installed may be a conventional wood burning fireplace with the exhaust flue closed or may be a direct vent fireplace, i.e., that where the combustion products whether artificial or wood, are vented to the exterior of the building. These vented fireplaces generally have multiple spaced apart sheet metal walls welded or otherwise connected together. One such fireplace of this type is illustrated in Shimek et al. U.S. Pat. No. 5,263,471. The multiple wall construction limits the actual log receiving space for fireplaces of given outside dimensions since the space between such walls causes a reduction in the width of the log receiving space. This is true whether the logs are wood or artificial. Additionally, fireplaces with this construction have a relatively expensive manufacturing cost, for various reasons, not the least of which is the amount of sheet metal required and the necessity of connecting the various walls together, the latter generally being done by welding.

In the aforesaid patent application an unvented fireplace construction is disclosed wherein a solution to this problem is proposed having ceramic refractory abutting the sheet metal sides of the fireplace and a ceramic refractory spaced for the sheet metal at the rear. Until now it has not been recognized that this structural concept may be applied to fireplaces which vent externally of the room in which the fireplace is mounted.

SUMMARY OF THE INVENTION

Consequently, it is a primary object of the present invention to provide a vented fireplace which is inexpensive to manufacture and has a large width combustion chamber.

It is another object of the present invention to provide a vented fireplace for wood or gas burning log sets that has a single sheet metal wall faced with ceramic refractory at the sides and having a ceramic refractory spaced from the rear.

It is a further object of the present invention to provide a vented fireplace wherein the total thickness of the sides is relatively small so that the width of the wood or log set receiving opening is maximized to permit use of large logs or log set.

Accordingly, the present invention provides a vented fireplace comprising sheet metal side and rear panels, the side panels having a pair of spaced apart horizontal sheet metal plates connected therebetween and having rear edges spaced from the rear panel, the lower of the plates supporting wood or a log set and the upper plate being supported below the upper edges of the rear and side panels to form an air duct with a top panel of the fireplace connected at the top edges of the side and rear panels, the upper plate and the top panel having apertures through which a conduit extends to communicate the combustion space between the upper plate and the top panel with an exhaust pipe, and a ceramic refractory panel supported at the rear edges of the plates spaced from the rear panel. The composite thickness or width of each side panel and the respective ceramic panel is very small so that the frontal dimension of the wood logs or gas-log set may be maximized. The lower plate is spaced above the supporting floor and air may enter beneath the lower plate and circulate upwardly between the rear panel and the rear ceramic refractory panel into the air duct and exit over the upper panel.

BRIEF DESCRIPTION OF THE DRAWINGS

The particular features and advantages of the invention as well as other objects will become apparent from the following description taken in connection with the accompanying drawings, in which.

DESCRIPTION OF THE PREFERRED EMBODIMENT

Figure 1:
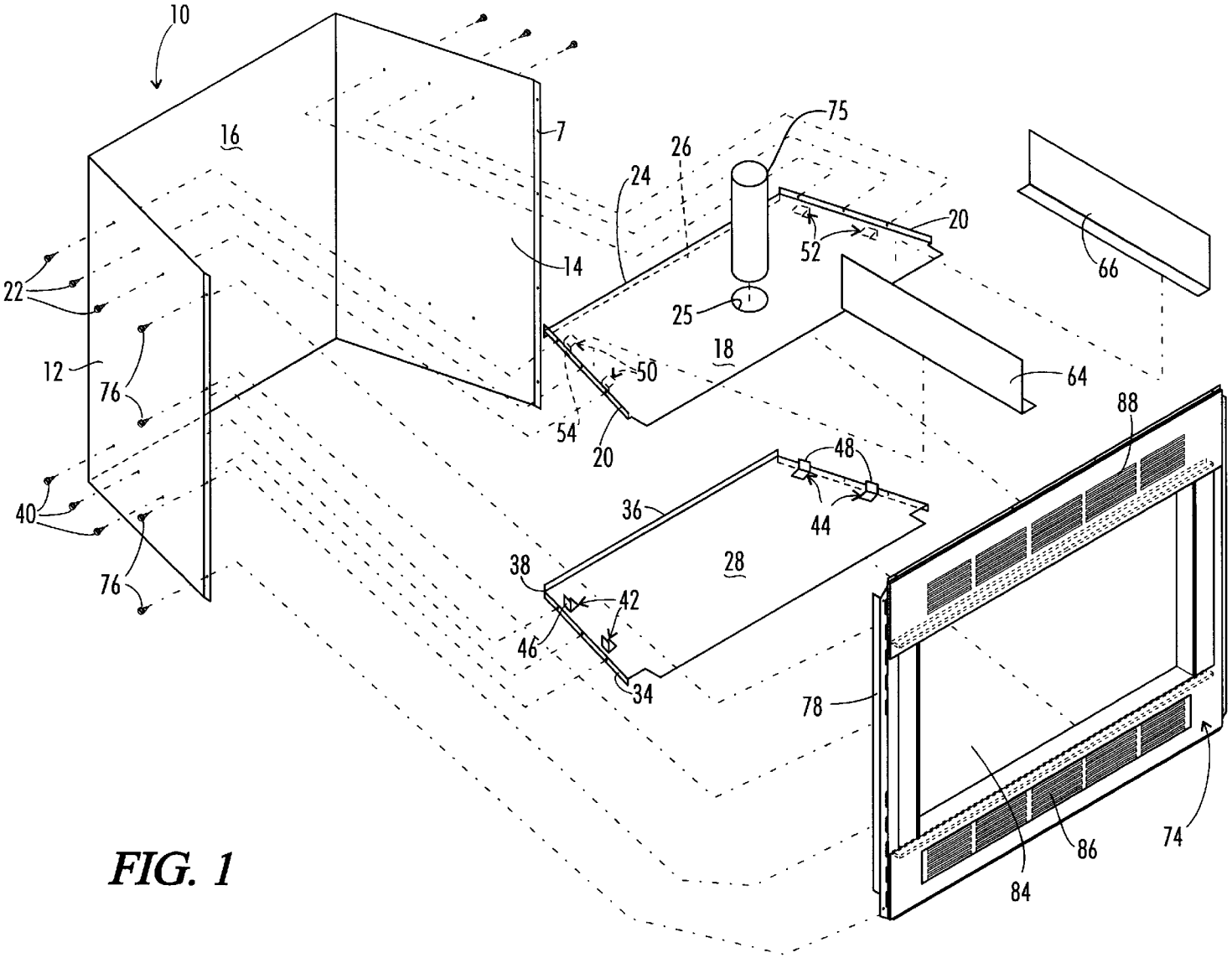
FIG. 1 is an exploded or disassembled perspective view illustrating substantially all the sheet metal components of a vented fireplace constructed in accordance with the present invention.
Figure 2:
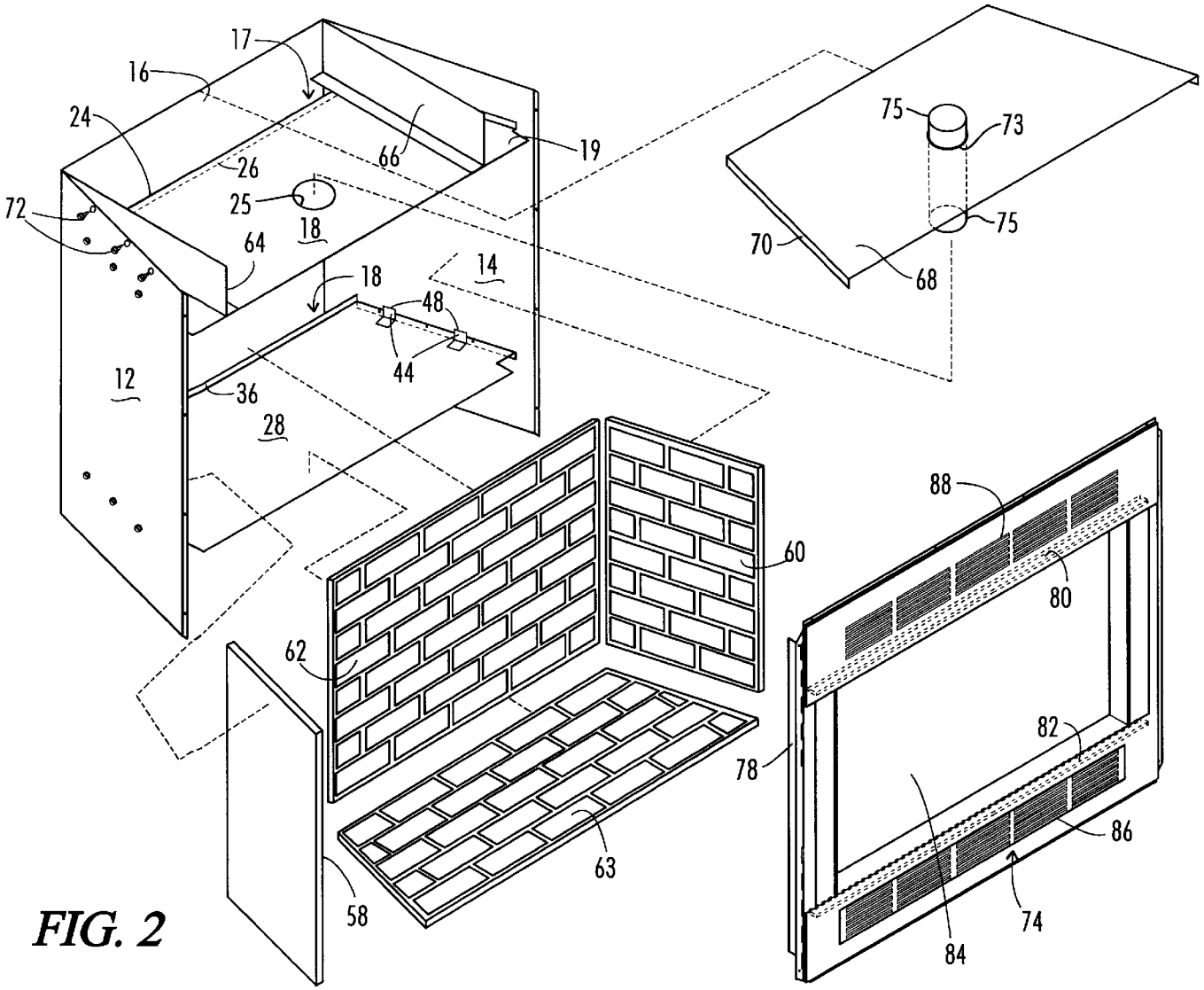
FIG. 2 is a perspective view of the fireplace of FIG. 1 prior to mounting the ceramic refractory panels, the top of the fireplace and the front face assembly.
Figure 3:
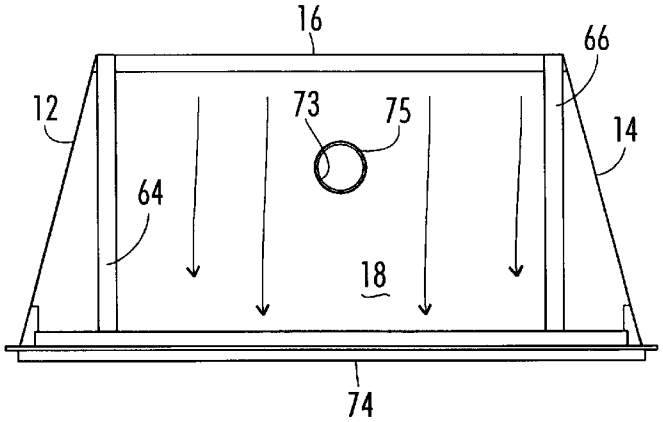
FIG. 3 is a top plan view of the assembled fireplace with the top removed.
Figure 4:
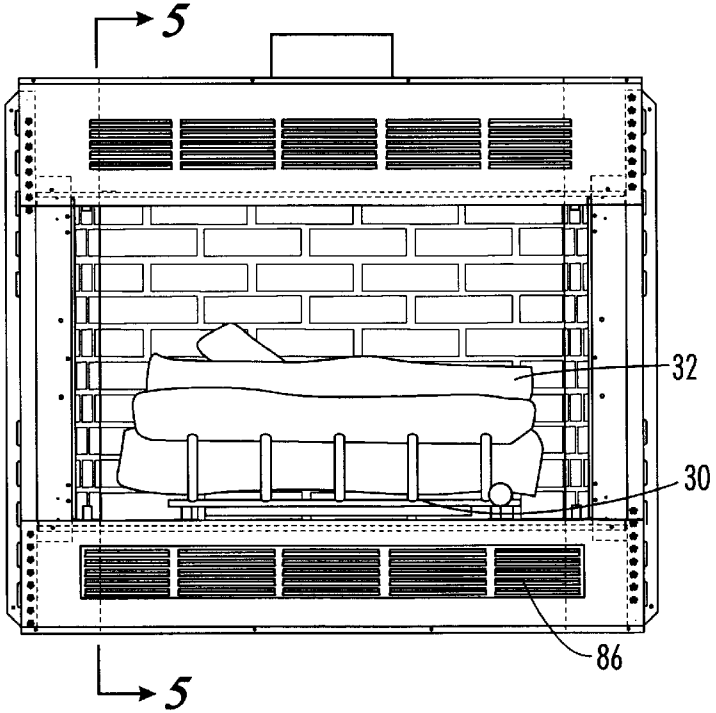
FIG. 4 is a front elevational view of the fireplace.
Figure 5:
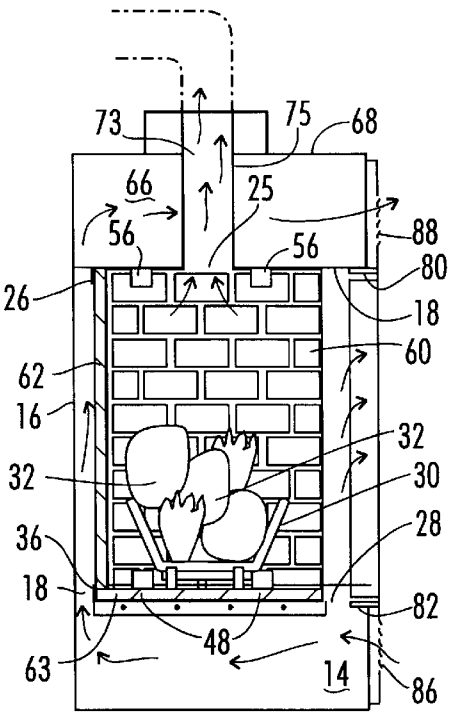
FIG. 5 us a vertical cross sectional view taken substantially along line 5—5 of FIG. 4.

Referring now to the drawing, a fireplace of the present invention as best illustrated in FIG. 1 includes a length of sheet metal forming the outer shell or casing 10 comprising side panels 12 and 14 and rear panel 16. The side panels as illustrated in the drawings preferably may be at an obtuse angle to the rear panel for aesthetics and to imitate a conventional fireplace. The sheet metal may be 28 gauge and thus may have a thickness of approximately 0.02 inch and therefore is relatively thin. The lower edges of the panels 12, 14 and 16 may rest on and be supported by the floor or the like (not illustrated) of the structure in which the fireplace is mounted. Secured to and extending between the side panels 12, 14 below the upper edges thereof is a sheet metal plate 18 having a configuration in plan substantially the same as that of the casing 10, the plate 18 forming the ceiling of the combustion chamber. The lateral edges of the plate 18 are bent upwardly out of the plane of the plate to form lips 20 and fasteners such as screws 22 extend through the side panels 12, 14 and are threaded into the respective lip 20 to secure the plate 18 to the side panels 12, 14. The depth of the plate 18 is less than the width of each side panel 12, 14 so that the rear edge 24 is spaced from the rear panel 16. Formed in the central portion of the plate 18 is an aperture 25 for reasons which hereinafter will be clear. Additionally, for reasons which hereinafter will become clear the rear edge 24 is bent downwardly out of the plane of the remainder of the plate 18 to form a lip 26.

Spaced below the plate 18 and also secured to and extending between the side panels 12, 14 is another sheet metal plate 28 substantially identical in shape and size to the plate 18 for forming the floor of the combustion chamber on which a grate 30 rests, the grate supporting wood logs or a log set 32. The plate 28 differs from the plate 18 in that it has downwardly extending lips 34 at the lateral edges and an upwardly extending lip 36 at the rear edge 38, the rear edge being spaced from the rear panel 16. Fasteners, such as screws 40, extend through the side panels 12, 14 and are threaded into the respective lip 34 to secure the plate 28 to side panels 12, 14.

Secured as by spot welding or the like to the plate 28 adjacent to but spaced approximately ¾ of an inch from each lateral edge is a pair of respective small bracket members 42, 44. The bracket members preferably have an L-shaped configuration, as illustrated, with the legs 46, 48 which are not fastened to the plate 28 extending upwardly. A similar pair of bracket members 50, 52 are secured to the lower surface of the upper plate 18, but here the legs 54, 56 which are not fastened to the plate 18 extend downwardly.

Disposed against the side panel 12 and held there by the leg 46 of the bracket member 42 and the legs 54 of the bracket member 50 is a first ceramic refractory panel 58, and a similar ceramic refractory panel 60 is disposed against the side panel 14 and held there by the legs 48 of the bracket members 44 and the legs 56 of the bracket members 52. The panels 58, 60 and a third ceramic refractory panel 62 may have a brickwork design on the faces thereof for aesthetics and to simulate the interior of the hearth of a conventional fireplace. Additionally, a refractory panel 63 may be seated on the plate 28 if desired. The panels 58, 60 have a height extending substantially from the upper surface of the plate 28 to the lower surface of the plate 18 and a width extending slightly less than the depth of the plates 18, 28. The third panel 62 which has a height substantially equal to those of the panels 58, 60 and a length slightly less than the width of the plates 18, 28 at the rear edges together with approximately twice the spacing or distance between the L-shape bracket members and the respective side panels 12, 14 is positioned at the rear of the plates 18, 20 against the lips 26, 36. The rear ceramic panel 62 is positioned in place before the sides ceramic panels 58, 60 and when these latter panels are slid between the respective metal panel 12, 14 and the outstanding legs of the bracket members with the rear edges abutting the rear panel 62 so that the three ceramic refractory panels are held in place to form the hearth of the fireplace. The thickness of the ceramic refractory panels 58, 60, 62 preferably is in the order of ¾ of an inch and thus the ceramic panel engaging legs of the bracket members are spaced from the respective sheet metal panels by approximately that amount so that the ceramic panels are sufficiently held and locked in place. Additionally, since the overall thickness of the fireplace at each side is ¾ of an inch plus the thickness of the respective sheet metal panels 12, 14, which provides a composite thickness of less than 1 inch, which is substantially less than that of the prior art fireplaces of this type, substantially larger, i.e., longer, wood logs and gas-log sets may be used in the hearth.

Secured to the upper surface of the upper plate 18 are a pair of spaced apart sheet metal baffles 64, 66, the baffles extending into engagement with the rear sheet metal panel 16. The baffles have a height such that the upper edges are at substantially the same elevation as the upper edges of the side panels 12, 14 and the rear panel 16. Positioned on the upper edges of the baffles 64, 66 and the upper edge of the rear panel 16 is a top sheet metal panel 68 having downwardly extending lips 70 at its sides. Fasteners such as screws 72 extend through the side panels 12, 14 and are threaded into the lips 70 to secure the top panel 68 in place. Formed in the central portion of the panel 68 is an aperture 73 which is aligned with and substantially concentric with the aperture 25 in the plate 18. A conduit 75 is disposed within and extends from the aperture 25 in plate 18 to and through the aperture 73 in the panel 68, the upper end of the conduit extending above the panel 68 and adapted to be connected to an exhaust pipe. Thus all of the products of combustion may be exhausted from the combustion chamber externally of the fireplace.

An aesthetic front face assembly 74 conventionally comprising longitudinal and vertical members forming a rectangular structure is securely connected to the front of the side panels 12, 14 by means of fasteners such as screws 76 extending through the side panels and into a mounting lip 78 at each side of the assembly 74. The front face assembly includes rearwardly and longitudinally extending ledges 80, 82 spaced apart and disposed at the elevations of the plates 18 and 28 respectively which act as braces to support the front edges of these plates thereby to provide the fireplace with the necessary rigidity. Although the front face assembly has a frontal opening 84 which permits room air for combustion to enter and heated air to be expelled into the room, the front face assembly includes a lower and upper set of slotted openings forming grills 86, 88 respectively extending through the longitudinally extending portions thereof below and above the frontal opening 84 respectively, the lower grill 86 functioning as a room air inlet and the upper grill functioning as a heated air outlet. Thus, when the fuel, either wood or gas-logs are lighted, room air enters the grill 86, flows rearwardly beneath the lower plate 28 and then upwardly in the space between the rear ceramic refractory panel 62 and the rear sheet metal panel 16, and then over the upper plate 18 between the baffles 64, 66 and below the top panel 68. as the air circulates it is warmed by the heat conducted through the plates 18 and 28 and prevents these plates from overheating. Of course, although not illustrated, since it is well known in the art, the gas supply line to the logs, valves and an igniter are conventionally mounted below the plate 28. Moreover, if desired an air mover, such as a fan (not illustrated) may be mounted beneath the plate 28 to circulate more of such air.

Numerous alterations of the structure herein disclosed will suggest themselves to those skilled in the art. However, it is to be understood that the present disclosure relates to the preferred embodiment of the invention which is for purposes of illustration only and not to be construed as a limitation of the invention. All such modifications which do not depart from the spirit of the invention are intended to be included within the scope of the appended claims.

I claim:

1. A fireplace comprising an outer enclosure having first and second spaced apart sheet metal side panels and a rear sheet metal panel connected to and separating said side panels at the rear of said side panels, a pair of substantially horizontally disposed spaced apart sheet metal plates within said outer enclosure connected to and extending from said first side panel to said second side panel, said plates having respective rear edges spaced from said rear sheet metal panel, the upper plate being spaced below upper edges of said first, second and rear sheet metal panels, a top panel secured to said side panels and said rear panel above said upper plate, said upper plate and said top panel having respective apertures extending therethrough and in substantial alignment, a conduit disposed in communication with said apertures, a first ceramic refractory panel having a size and shape for abutting said first side panel between said plates and having a rear edge terminating at the rear edges of said plates, a second refractory panel having a size and shape for abutting said second side panel between said plates and having a rear edge terminating at the rear edge of said plates, holding means for holding each ceramic refractory panel in substantial abutment with the respective sheet metal side panel with substantially no air space therebetween, a third ceramic refractory panel disposed intermediate and in abutment with said first and second ceramic panels at the location of the rear edges thereof, and locating means associated with each plate for positioning said third ceramic panel firmly in place at the location of the rear edges of said plates spaced from said rear sheet metal panel, whereby a combustion chamber is formed intermediate the lower plate and the upper plate and products of combustion may exhaust through said conduit.

2. A fireplace as recited in claim 1, wherein said holding means comprises upstanding bracket members fastened to each of said plates spaced from a respective side panel by an amount substantially equivalent to the thickness of a ceramic panel.

3. A fireplace as recited in claim 1, wherein said locating means comprises a lip formed at the rear edge of each plate, the lip on the lower panel extending upwardly, and the lip on the upper panel extending downwardly.

4. A fireplace as recited in claim 3, wherein s aid holding means comprises upstanding bracket members fastened to each of said plates spaced from a respective side panel by an amount substantially equivalent to the thickness of a ceramic panel.

5. A fireplace as recited in claim 4, wherein said sheet metal panels comprise a unitary member.

6. A fireplace as recited in claim 1, wherein the lower plate is spaced above lower edges of said first, second and rear sheet metal panels, and baffles secured to the upper surface of said upper plate and extending rearwardly into engagement with said rear sheet metal panel, said baffles having upper edges substantially at the same elevation as the upper edges of said first, second and rear sheet metal panels said top panel being disposed on the upper edges of said baffles and at least the upper edge of said rear plate to form an air passageway below said lower plate, behind said third ceramic panel and over said upper plate below said top panel.

7. A fireplace as recited in claim 6, wherein said holding means comprises upstanding bracket members fastened to each of said plates spaced from a respective side panel by an amount substantially equivalent to the thickness of a ceramic panel.

8. A fireplace as recited in claim 7, wherein said locating means comprises a lip formed at the rear edge of each plate, the lip on the lower panel extending upwardly, and the lip on the upper panel extending downwardly.

9. A fireplace as recited in claim 8, wherein said sheet metal panels comprise a unitary member.

* * * * *